US005090894A

United States Patent [19]

Riecke et al.

[11] Patent Number: 5,090,894

[45] Date of Patent: Feb. 25, 1992

[54] ENHANCED AIR/FUEL MIXING FOR AUTOMOTIVE STIRLING ENGINE TURBULATOR-TYPE COMBUSTORS

[75] Inventors: George T. Riecke, Ballston Spa; Robert E. Stotts, Newark, both of N.Y.

[73] Assignee: Mechanical Technology Incorporated, Latham, N.Y.

[21] Appl. No.: 647,539

[22] Filed: Jan. 29, 1991

[51] Int. Cl.[5] ..... F23M 9/00

[52] U.S. Cl. ..... 431/183; 60/517; 431/116; 239/406

[58] Field of Search ..... 431/8-10, 431/180-184, 187, 115, 116; 60/517; 239/403-406

[56] References Cited

U.S. PATENT DOCUMENTS

| | | | |
|---|---|---|---|
| 3,542,500 | 11/1970 | Norcross et al. | 431/181 |
| 3,720,495 | 3/1973 | Zink et al. | 431/184 |
| 3,808,803 | 5/1974 | Salvi | 431/183 |
| 4,400,151 | 8/1983 | Vatsky | 431/184 |

*Primary Examiner*—James C. Yeung

*Attorney, Agent, or Firm*—Kane, Dalsimer, Sullivan, Kurucz, Levy, Eisele & Richard

[57] ABSTRACT

The invention relates to the improved combustion of fuel in a combustion chamber of a stirling engine and the like by dividing combustion into primary and secondary combustion zones through the use of a diverter plate.

7 Claims, 3 Drawing Sheets

ENHANCED AIR/FUEL MIXING FOR AUTOMOTIVE STIRLING ENGINE TURBULATOR-TYPE COMBUSTORS

The Government of the United States of America has rights in this invention pursuant to Contract No. DEN 3-32 awarded by the Department of Energy.

FIELD OF THE INVENTION

The present invention relates to an improved combustor in particular a cumbustor for liquid and/or gas fueled Stirling engine.

BACKGROUND OF THE INVENTION

The standard turbulator-type combustor (also known as the EGR combustor) for the automotive Stirling engine is basically illustrated in FIG. 1 and FIG. 2. It consists of a radial in-flow turbulator mounted on top of a combustor shell. The combustion air flows into a turbulator, which inputs a large amount of swirl to the air, and exits out the bottom of the turbulator. At the exit of the turbulator, the air tends to be concentrated in an annular ring at the bottom of the turbulator. Downstream of this, the air flow expands to fill in the center of the region below the turbulator, and also expands beyond the turbulator outer diameter. A fuel nozzle sprays a finely atomized fuel spray into the air stream as shown in FIG. 2. The air and fuel do not mix appreciably in the turbulator, but rather below it. This results in relatively poor air/fuel mixing especially if the fuel spray is too fine and, also can result in an unstable flame, particularly under cold conditions and low to moderate fuel flows.

SUMMARY OF THE INVENTION

Accordingly, it is a principal object of the invention to provide for the improved combustion of fuel in a turbulation type combustor.

It is a further object of the invention to provide for such improved combustion in a relatively simple yet effective manner.

It is a yet further object of the invention to provide for such improved combustion using liquid or gaseous fuel.

These and other objects are provided for by the present invention wherein the air/flow mixing can be enhanced by inserting a diverter plate into the turbulator. This plate serves to divert a portion of the incoming air to a zone closer to the fuel nozzle, increasing the air velocity. The fuel spray mixes with this air to form a fuel rich zone where the combustion air initiates a flame front. Downstream secondary air mixes with the already burning fuel and provides air to complete the fuel combustion. This arrangement has been found to greatly enhance the flame stability in combustion.

A further enhancement of the combustion process is accomplished by providing a tubular extension on the inner diameter of the diverter plate. This tube induces a recirculation zone which results in a stable clean-burning flame which initiates from a ring of flame in the recirculation zone. A benefit is that the balance of the fuel spray passes through this ring of flame and is further vaporized before it encounters the secondary air. This provides a clean, stable combustion of even moderately heavy fuel oil.

The aerodynamic characteristics of the diverter plate is also advantageous for in the combustion of natural gas and/or a liquid/gas fuel combination.

BRIEF DESCRIPTION OF DRAWINGS

Thus by the present invention, its objects and advantages will be realized the description of which should be taken in conjunction with the drawings, wherein.

DETAILED DESCRIPTION OF THE PREFERRED EMBODIMENT

Figure 1:
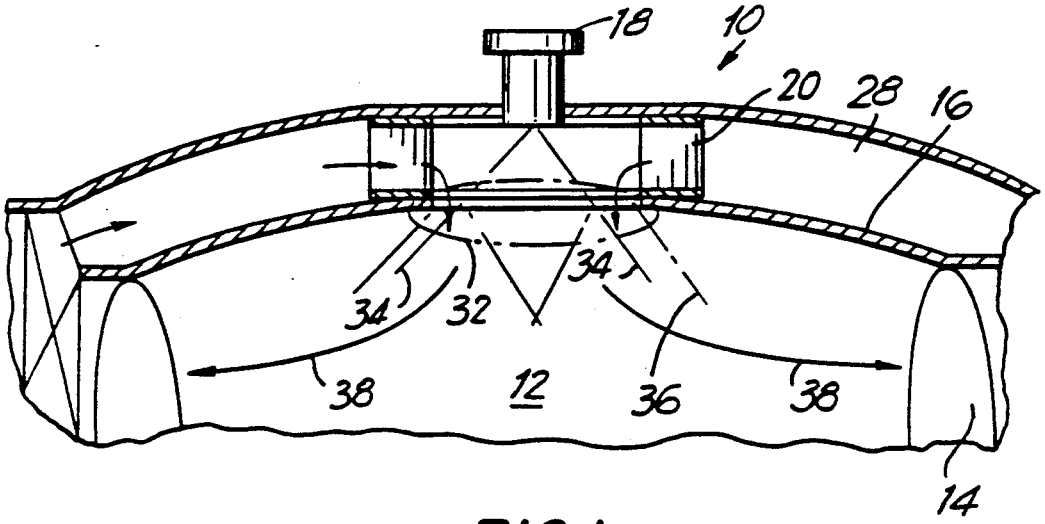
FIG. 1 PRIOR ART
FIG. 1 is a sectional view of a combustor of Stirling engine which is in the prior art.
Figure 2:
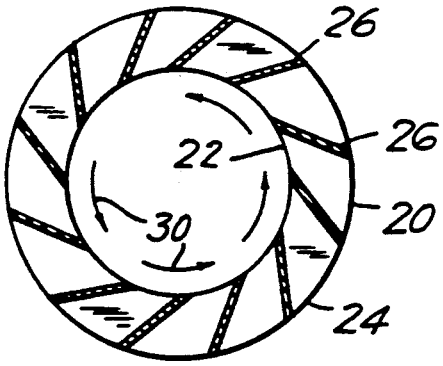
FIG. 2 PRIOR ART
FIG. 2 is a sectional view of a turbulator and the air flow provided thereby which is in the prior art.

Turning now more particularly to the drawings, in FIGS. 1 and 2 there is shown a prior art combustor 10 which may be used in a Stirling engine. The combustor 10 includes a combustion chamber 12 surrounded by heater tubes 14 and defined by a cylindrical combustion shell 16. A fuel nozzle 18 is provided for the injection of fuel into the combustion chamber 12. A circular turbulator 20 is disposed at the top of the combustor shell 16 adjacent to which fuel is injected into the chamber 12. The turbulator 2 includes inner 22 and outer 24 surfaces between which a plurality of turning vanes 26 are provided. The turbulator 20 receives combustion air via pathway 28 and serves to swirl the air entering the combustion chamber 12 via the vanes 26 as indicated by arrows 30.

This creates a mixing zone and flame front generally indicated by the annular ring at 32. The spray of fuel is shown generally at 32 with an air flow envelope indicated by lines 34. The combustion gas exits through the heated tubes 14 as indicated by lines 35.

The exiting air out of the turbulator 20 tends to concentrate in the annular ring 32. Downstream it expands to fill in the center of the region below the turbulator 20 and beyond as indicated by lines 34.

The fuel nozzle atomizes the fuel and sprays it into the air stream formed by the turbulator 20. Mixing occurs below the turbulator 20 at 34 with little mixing occurring thereabove. This results in a relatively poor air/fuel mixing especially if the fuel spray is too fine. This results in an unstable flame especially under cold conditions and low to moderate fuel flows.

Figure 3:
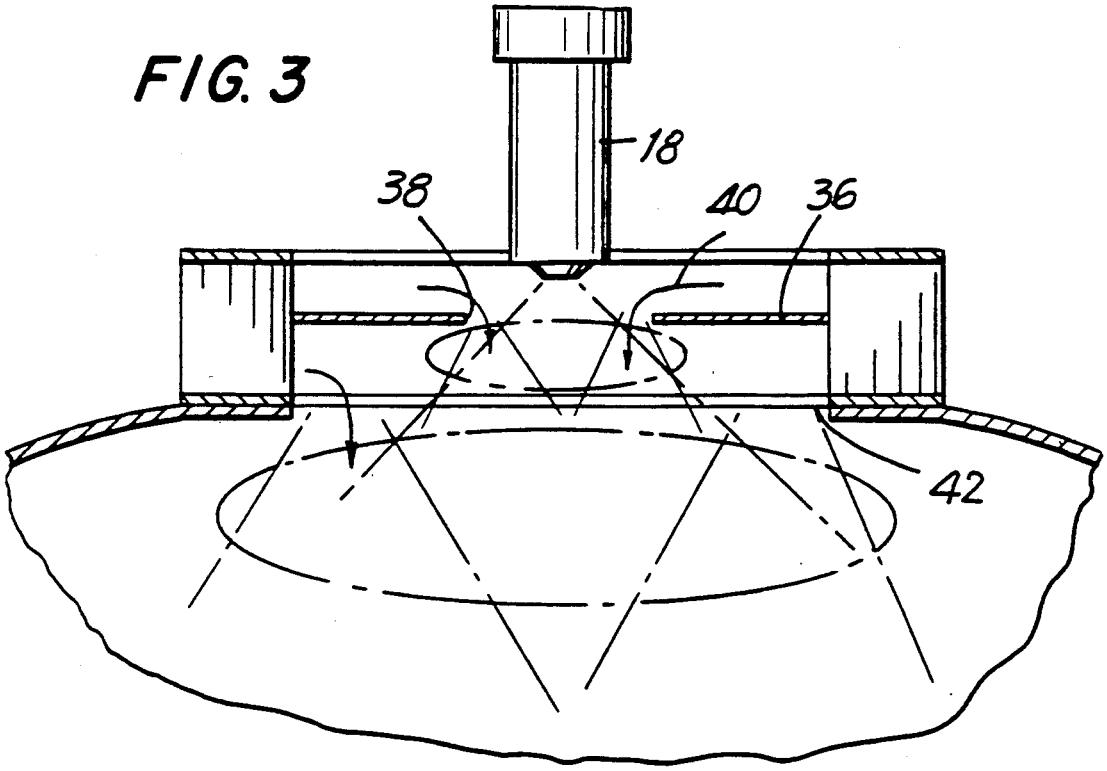
FIG. 3 is a sectional view of a combustor including a diverter plate, incorporating the teachings of the present invention.

A means of enhancing such an air/fuel mixing is shown in FIG. 3. In this regard, a circular diverter plate 36 is provided about the internal diameter of the turbulator 20. This diverter plate 36 is flat and has an annular opening 38 axially positioned with respect to nozzle 18. The plate 36 serves to divert a portion of the incoming air from the turbulator 20 to a area close to the nozzle 18 providing primary air 40 thereto. The reduction in radius of the swirling primary airflow increases the velocity of the air, resulting in an increased differential between the air and fuel. This improves the mixing of the fuel and air. Mixing occurs in this area to provide a fuel rich zone where combustion initiates creating a flame front. Downstream from this, below turbulator 20, the balance of the combustion air or secondary air 42 mixes with the already burning fuel providing sufficient air to complete the fuel combustion. This arrangement serves to greatly enhance the flame stability during combustion.

Figure 4:
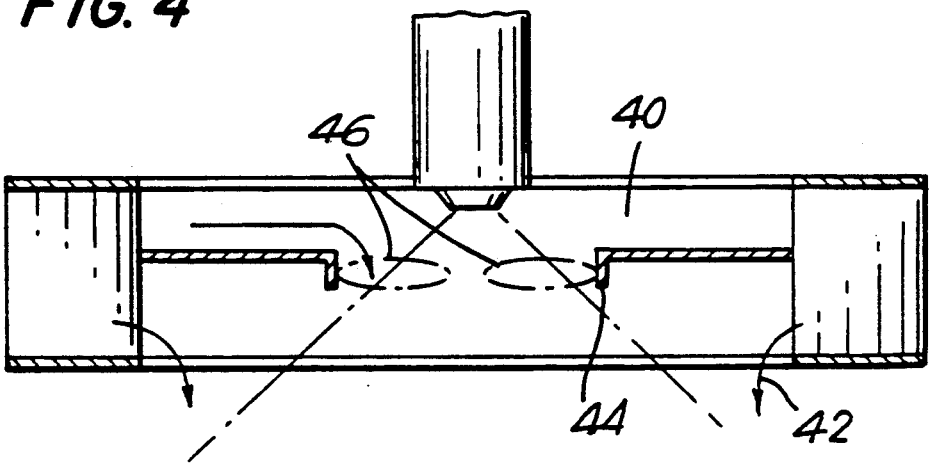
FIG. 4 is a sectional view of a combustor which includes a second version of a diverter plate, incorporating the teachings of the present invention.

Turning now to FIG. 4, an annular flange 44 is provided about the annular opening of diverter plate 36. Flange 44 provides for a recirculation zone 46 which a stabilizing of flame in the recirculation zone 46. In addition the balance of the fuel spray passes through this ring of flame and is further vaporized before it encounters the secondary air. Clean stable combustion has been achieved with this arrangement even using moderately heavy fuel oil (e.g. #2 diesel fuel at 16° F.).

Figure 5:
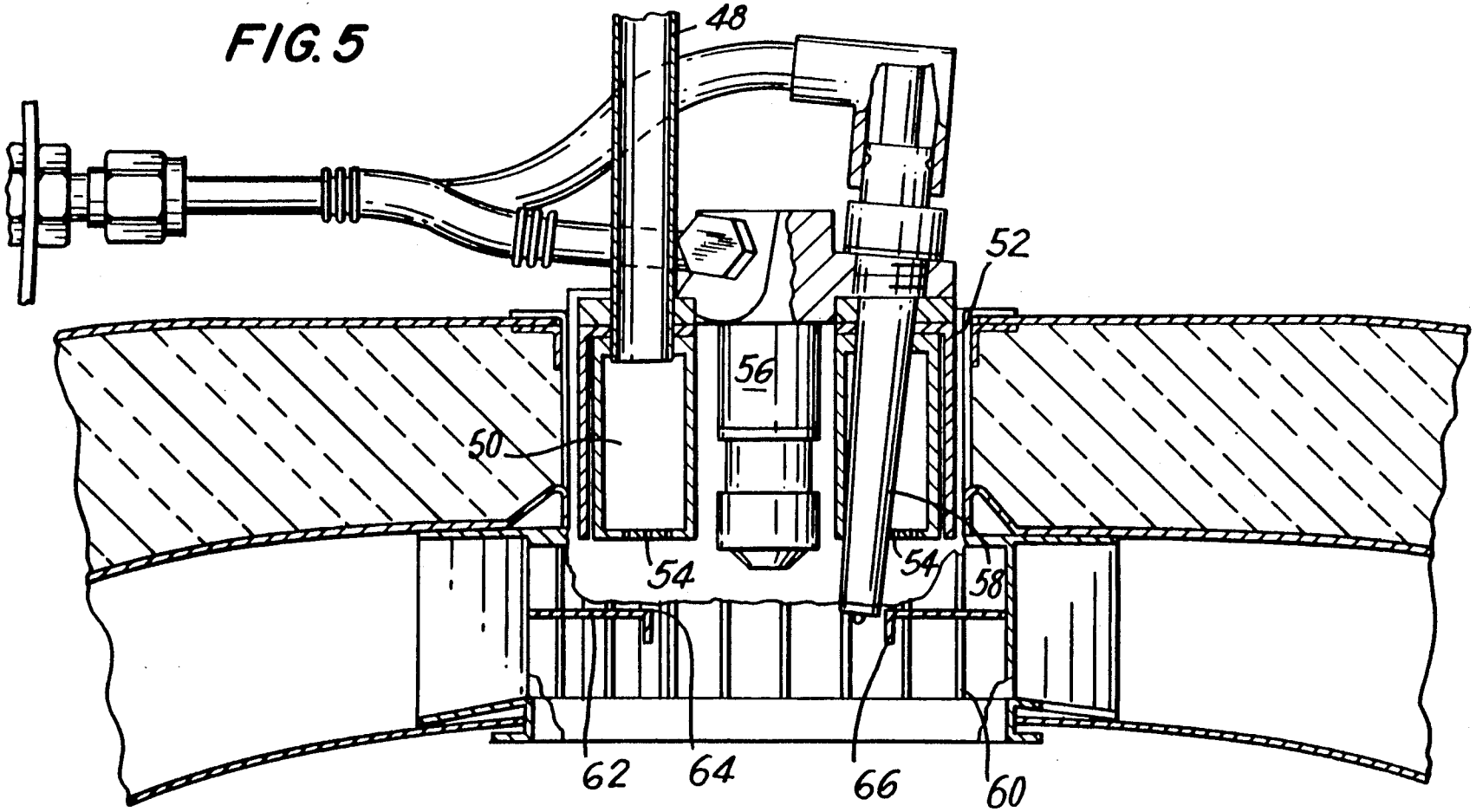
FIG. 5 is a sectional view of a combustor for either liquid or gas fuels without changing hardware including a diverter plate, incorporating the teachings of the present invention.
Figure 1:
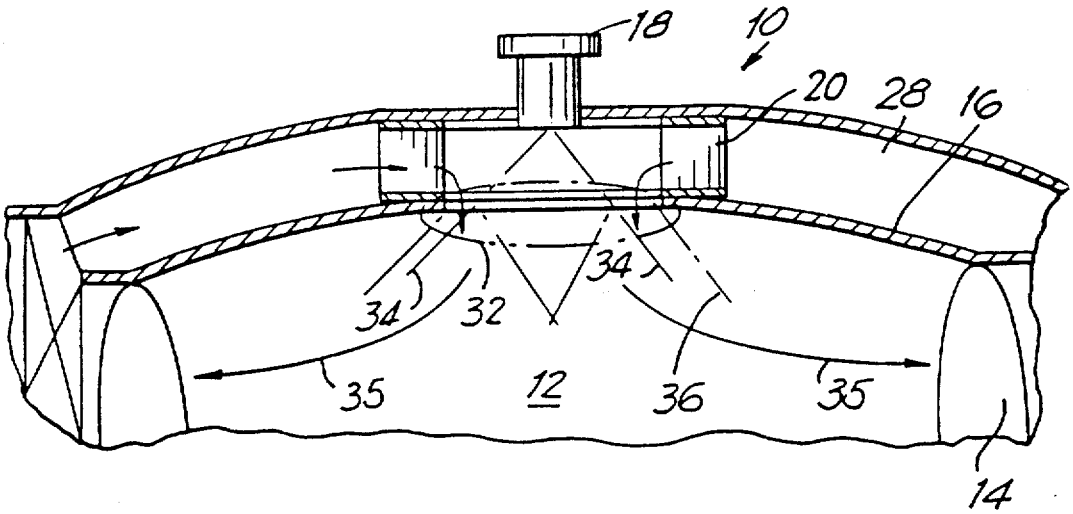
FIG. 1 PRIOR ART
Figure 2:
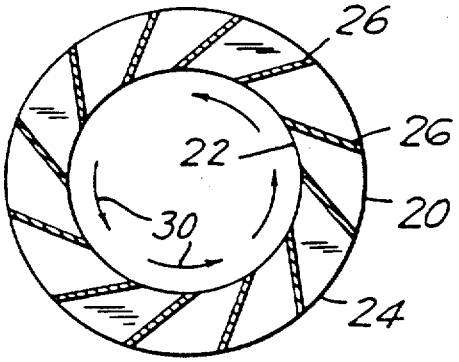
FIG. 2 PRIOR ART
Figure 3:
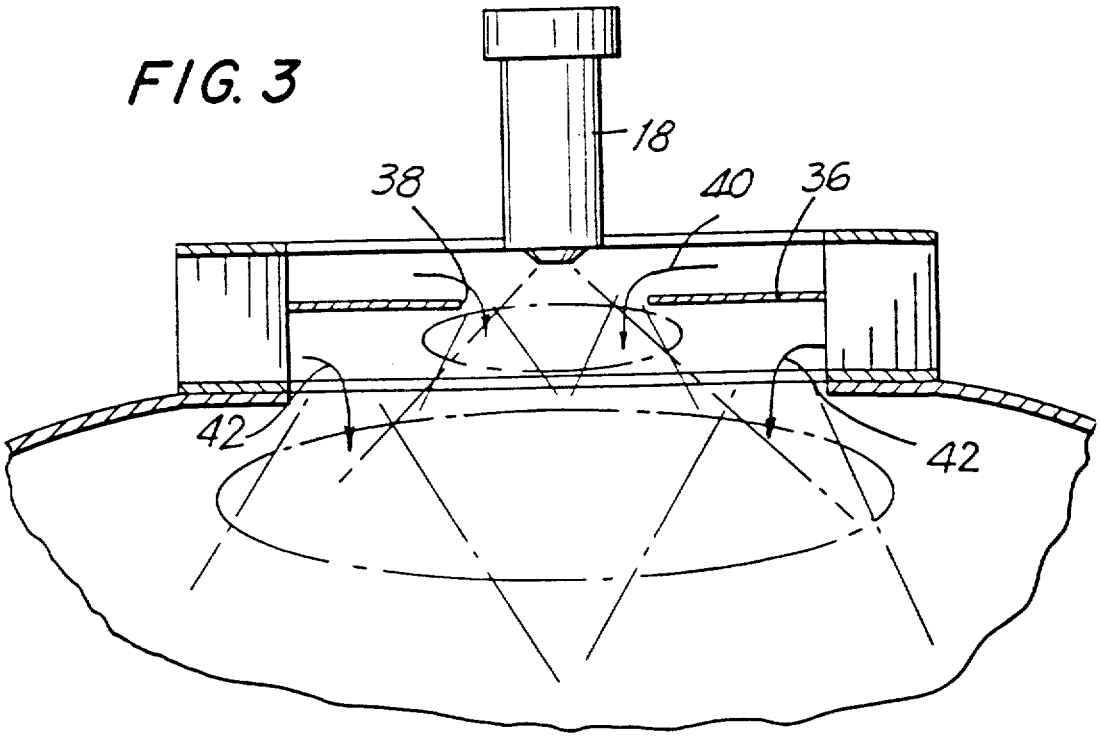
Figure 4:
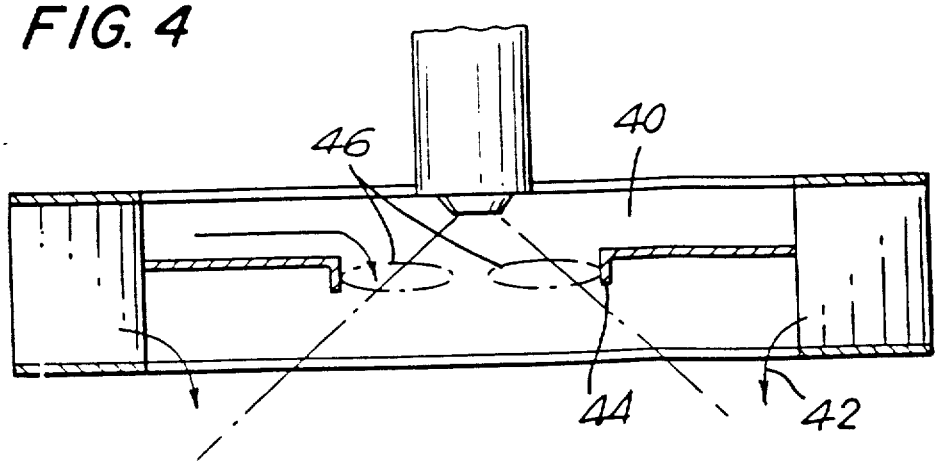

The use of the diverter plate arrangement is also useful when the fuel is either a gas or liquid. This is shown in FIG. 5 wherein both a liquid and gas fuel nozzle is used, providing multi-fuel operation without changing hardware. In this regard a gas supply 48 is provided coupled with an annular gas manifold 50 which is supported via a nozzle mount 52. Annular gas discharge orifices 54 are provided which comprise a series of opening disposed thereabout. A liquid fuel nozzle 18 is also provided along with an ignitor 58. The ignitor 58 passes through and is disposed below the gas manifold 50 adjacent the exit end of the fuel nozzle 18. Again an annular turbulator 60 is provided to provide the swirl of combustion air. Disposed annularly adjacent the turbulator 60 is a diverter plate 62 having an annular opening 64 axially positioned with respect to nozzle 18. Plate 62 is provided with an annular flange 66.

The gas manifold 50 shown was selected to provide the largest internal flow areas possible to keep fuel pressure losses low. In this regard the fuel injection orifices are located as close to the turbulator vanes as possible in the primary air flow passage, with as many holes as possible to distribute the fuel flow in the air. This allows the maximum mixing of the fuel and air prior to combustion. This design for fuel injection with the aerodynamics of the diverter plate 62 produces a highly stable and efficient flame allows the use of very lean operation for the purpose of reducing NOx emissions without compromising Unburned Hydrocarbon (UHC) and Carbon Monoxide (CO) emissions, which in typical state-of-the-art burners is the strong tendency for combustion instability, particularly at high air flows, with lean operation. This tends to cause intermittent or complete blow-outs of the flame. Intermittent blow-outs result in soot, high CO and UHC emissions. The present avoids such characteristics, producing extremely low emissions with natural gas.

Natural gas combustion may be added to an existing liquid fuel burner without disrupting liquid fuel operation. The configuration produces extremely stable operation over a broad range of fuel and air flows, allowing many combustion and aerodynamic options to be utilized for effective emissions reduction. In addition, ignition over a broad range of fuel flows is possible. The use of system criteria such as starting response and low emissions can be used for starts rather than ignitability, which is typical with internal combustion engines.

A well formed, efficient, and extremely clean burning flame zone is aerodynamically formed within the burner. No mechanical devices such as flameholders are required to stabilize the flame. The concentric staging of the air flow contains the fuel emissions from being formed through premature quenching of the flame on cooler metal surfaces such as the burner walls. The hardware configuration is simple and cost effective. The surface of the gas manifold 50 which contains the gas discharge orifices 54 serves to replace an existing flat surface of the turbulator. This prevents any disturbance of the aerodynamics in that area.

The natural gas fuel is injected into the annulus between the diverter plate 62 and the top plate of the turbulator. To further induce improved mixing of gas and air angled holes directed toward the turbulator vane trailing edges. Various sized holes for the gas orifice may be used to provide the desired match of gas/air velocities for optimum mixing. For purely natural gas operation, the area occupied by the liquid fuel nozzle can be used for nozzles to inject water, air, or exhaust gases to assist in the control of emissions.

Thus by the present invention, its object and advantages are realized, and although preferred embodiments have been disclosed and described in detail herein, its scope should not be limited thereby, rather its scope should be determined by that of the appended claims.

What is claimed is:

1. A combustor for use in a Stirling engine and the like comprising:

a combustor chamber;

a fuel inlet couple to said chamber to inject fuel therein;

a turbulator means disposed in said chambers downstream of said fuel inlet means for injecting combustion air into said chamber, said turbulator means being so positioned to cause a mixing of the combustion air and fuel injected into said chamber;

diverter means for dividing said combustion air and creating a primary mixing zone of fuel and combustion air and a secondary mixing zone downstream of the primary mixing zone; and wherein said primary mixing zone comprises a fuel rich zone where combustion initiates and said secondary mixing zone has sufficient combustion air to complete combustion of the fuel.

2. In accordance with claim 1 wherein said diverter means comprises a plate member position to divide combustion air exiting the turbulator means and includes an axial opening positioned with respect to the fuel inlet.

3. In accordance with claim 2 wherein said diverter means includes an annular flange about said axial opening providing a recirculation zone.

4. In accordance with claim 1 wherein said fuel inlet includes means for injecting fuel in liquid and gaseous form.

5. In accordance with claim 4 which includes a gas manifold means symmetrically disposed about a centrally located liquid fuel nozzle.

6. In accordance with claim 5 wherein said diverter means comprises a plate member position to divide combustion air exiting the turbulator means and includes an axial opening positioned with respect to the fuel inlet.

7. In accordance with claim 6 wherein said diverter means includes an annular flange about said axial opening providing a recirculation zone.

* * * * *

UNITED STATES PATENT AND TRADEMARK OFFICE

CERTIFICATE OF CORRECTION

PATENT NO. : 5,090,894

DATED : February 25, 1992

INVENTOR(S) : Riecke and Stotts

It is certified that error appears in the above-identified patent and that said Letters Patent is hereby corrected as shown below:

Col. 1, line 30, please change "2" to --1--

Col. 1, line 48, please change "air/flow" to --air/fuel--

Col. 2, line 35, please change "2" to --20--

Col. 4, line 13, after "air", please add --,--

Col. 4, line 14, after "edges", please add --may be incorporated--

Please change Figures 1 and 3 as shown on the attached sheets:

Signed and Sealed this

Twenty-eighth Day of December, 1993

*Attest:*

Bruce Lehman

BRUCE LEHMAN

*Attesting Officer*

*Commissioner of Patents and Trademarks*